United States Patent [19]

Vranish et al.

[11] 4,421,205

[45] Dec. 20, 1983

[54] MAGNETIC SHIP'S HOG LINE HOLDER

[75] Inventors: John M. Vranish, Crofton; Charles E. Maggelet, Silver Spring, both of Md.

[73] Assignee: The United States of America as represented by the Secretary of the Navy, Washington, D.C.

[21] Appl. No.: 344,450

[22] Filed: Feb. 1, 1982

[51] Int. Cl.[3] ..... E04G 3/10

[52] U.S. Cl. ..... 182/82; 182/142; 182/150

[58] Field of Search ..... 182/142, 82; 294/65.5; 248/206 A, 206 R; 335/285, 286

[56] References Cited

U.S. PATENT DOCUMENTS

| | | | |
|---|---|---|---|
| 2,426,795 | 9/1947 | Sjostrom | 294/65.5 |
| 2,543,348 | 2/1951 | Briese | 182/36 |
| 3,051,875 | 8/1962 | Farwell | 335/285 |
| 3,120,216 | 2/1964 | Neinhardt | 335/285 |
| 3,241,796 | 3/1966 | Asher | 248/206 A |
| 3,335,378 | 8/1967 | Corvino | 294/65.5 |
| 3,375,900 | 4/1968 | Conley | 182/142 |
| 3,421,551 | 1/1969 | Currier | 52/221 |
| 3,423,708 | 1/1969 | Christian | 335/285 |
| 3,642,122 | 2/1972 | Von Ende | 335/285 |
| 4,295,593 | 10/1981 | Kensoue | 248/206 A |

FOREIGN PATENT DOCUMENTS

| | | | |
|---|---|---|---|
| 745835 | 3/1956 | United Kingdom | 182/129 |

*Primary Examiner*—Reinaldo P. Machado
*Assistant Examiner*—Alvin C. Chin-Shue
*Attorney, Agent, or Firm*—R. F. Beers; K. E. Walden; D. J. Breh

[57] ABSTRACT

A magnetic holder for pulling in and securing a platform and personnel to the hull of a ship to be serviced is disclosed. A lightweight corrosion resistant body member houses a permanent magnet and has an extension for receiving an elongated tool with which the holder is brought in contact with the ship's hull. A flexible resilient light attaches the platform to the holder and allows the platform to be pulled to the hull. Easy removal of the holder is accomplished by applying an external force to the extension creating a turning moment to overcome the magnetic holding frame.

11 Claims, 5 Drawing Figures

MAGNETIC SHIP'S HOG LINE HOLDER

BACKGROUND OF THE INVENTION

This invention relates to the field of magnetic holders. More particularly the invention relates to magnetic holders utilizing a permanent magnet having high magnetic holding force but is easily removed from the work surface.

In the area of ship maintenance it is necessary to provide a way for personnel to service hulls. Large ships, such as ocean going vessels have hulls that curve in below the deck line so that it is not possible to reach the hull when lowered down from the deck on devices such as platforms. When using platforms to lower personnel and equipment it is necessary to pull them to the hull so that the hull can be reached.

Heretofore, ships have been provided with hooks welded onto their hulls. Personnel servicing the hull tie onto and off from these hooks with ropes thereby enabling them to pull themselves to the surface and move about to various locations on the hull. Depending on the size of ship, hundreds of these hooks are required. These hooks are subject to corrosion and must be served by painting and rewelding just as the hull is serviced. Additionally, it is time consuming and not an easy task to tie onto and off from these hooks.

Another means for allowing personnel to move about over the surface of the hull includes plunger like devices that create a vacuum between the surface and plunger to hold the device and personnel. These devices are not always effective due to surface irregularities and corrosion that prevent the necessary seal between the surface and plunger material. Also, it is difficult for personnel to hold the plunger and perform the servicing functions at the same time. These devices can and do develop high holding force when a good seal is obtained and can be difficult to remove without prying and twisting.

It can be appreciated that it is highly desirable to have a means for allowing personnel to pull themselves to the surface of the hull of a ship and for allowing them to move about over the surface with minimum effort.

SUMMARY OF THE INVENTION

It is an object of the invention to provide a device for pulling personnel to the surface of the hull of a ship to be serviced.

It is another object of the invention to provide a device that allows personnel to move over the surface of the hull of a ship.

Another object of the invention is to provide a device that has high holding force, but is removable from the hull's surface with minimum effort.

Another object of the invention is to provide a device for securing equipment to the hull of a ship whose holding force is not significantly effected by irregularities in the hull.

Other objects and many attendant advantages will be readily appreciated as the invention becomes better understood by reference to the detailed description when considered in conjunction with the accompanying drawings.

The objects are achieved and the shortcomings of the prior art are overcome by attaching a permanent magnet within a housing. An extension having a cavity for receiving an elongated tool, such as a pole, is located at a point on the periphery of the housing. The extension also includes a rigid member to which a force is applied for removing the device from the surface. The elongated tool is inserted into the cavity and used to bring the device in contact with the hull where the magnetic force of the magnet secures the device thereto. A flexible resilient line attached to the housing at the magnetic center of gravity extends to and secures the platform on which the personnel are located. By taking in the line, the platform is pulled to the hull. Release of the device from the hull is accomplished by pulling on the rigid member, which creates a turning moment about a point on the housing in contact with the hull. This moment is greater than, and in opposition to, the moment about the same point created by the magnetic force.

DETAILED DESCRIPTION OF THE PREFERRED EMBODIMENT

Figure 1:
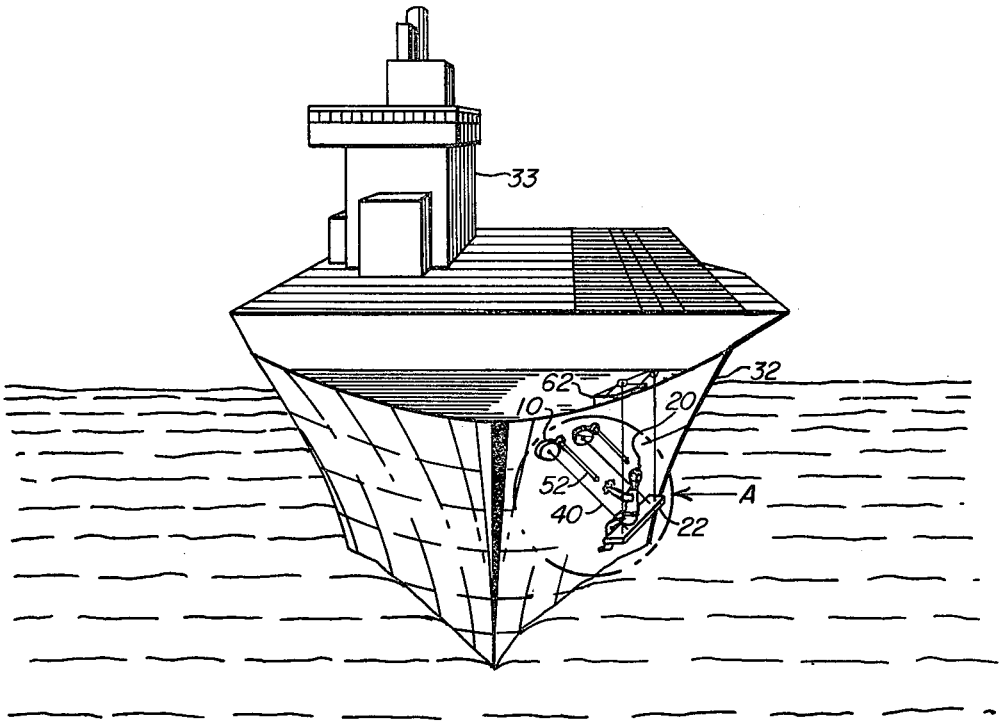
FIG. 1 is a pictorial representation of the invention in use by personnel servicing the hull of a ship.
Figure 2:
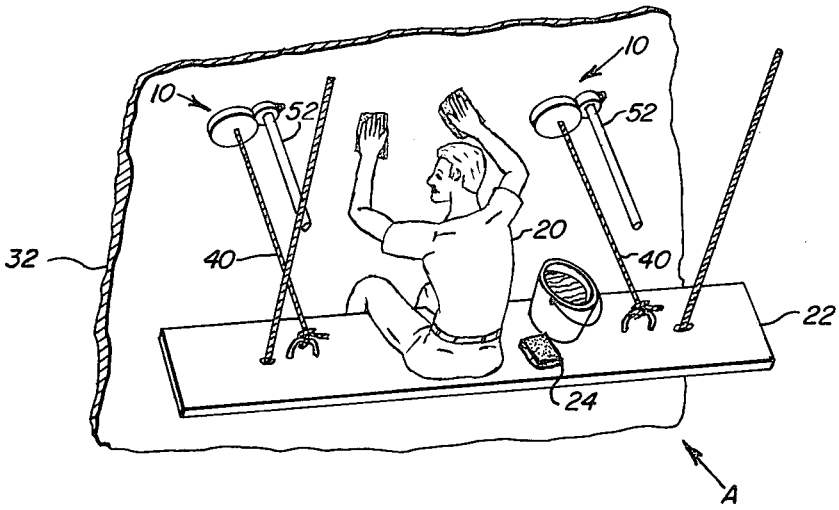
FIG. 2 is an enlarged pictorial view of portion A in FIG. 1 showing the invention in use.
Figure 4:
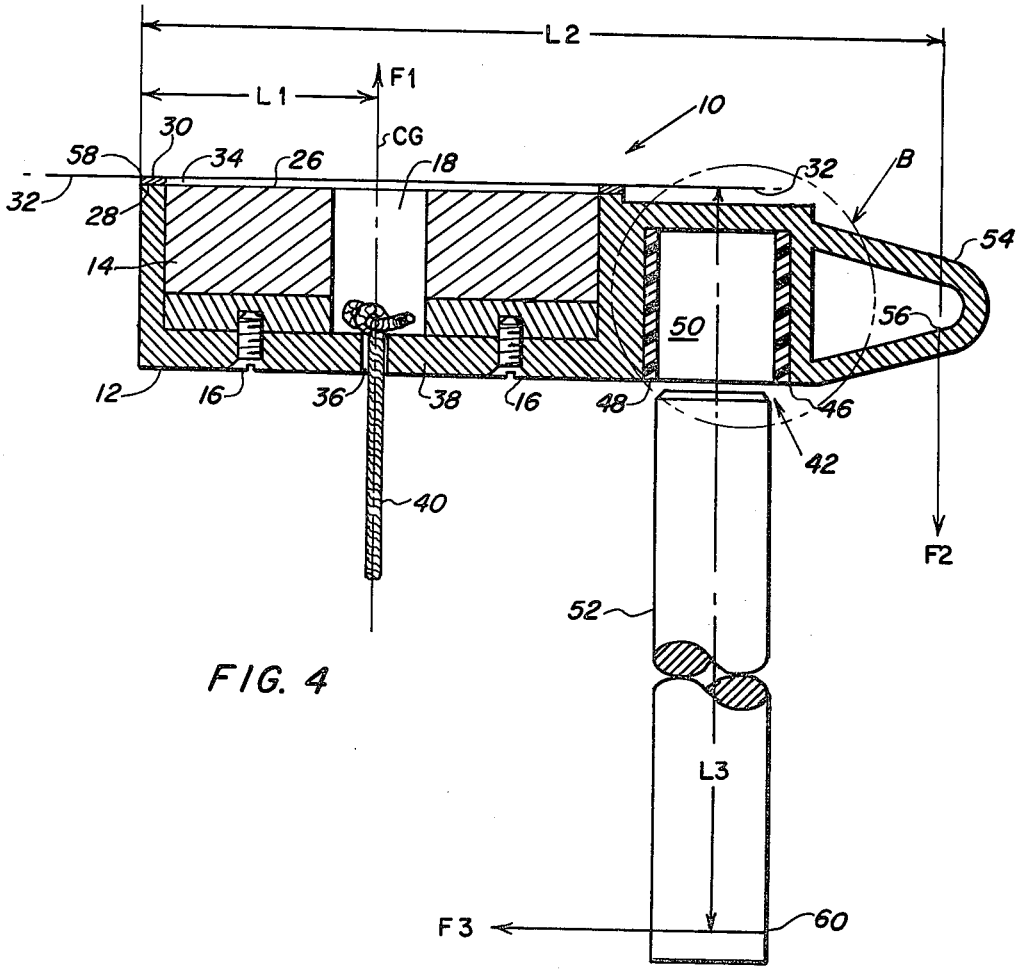
FIG. 4 is a vertical transverse section of the invention showing details of the preferred embodiment.

Referring to the drawings, and as best shown in FIG. 4 there is a magnetic holder 10 comprising a body member 12 having a permanent magnet 14 secured by screws 16 within a cavity 18. Permanent magnet 14 is of a type that has high magnetic holding force, and it has been found, that for the typical application contemplated herein, a minimum magnetic holding force of 60 pounds is required to safely secure personnel 20, platform 22, and associated equipment 24 as illustrated in FIGS. 1 and 2.

Although not to be considered limited thereto, a permanent magnet of a material known as Indox 5, and more particularly a permanent magnet made of this material by Indiana General Company, type 8 meets the minimum holding force requirements.

The depth of cavity 18 is such that the outer surface 26 of magnet 14 does not extend beyond body member surface 28. Secured to body member surface 28 is a gasket 30 for protecting body member surface 28 and the hull 32 from being damaged when the device is in contact the hull of ship 33. Gasket 30 also helps prevent slipping on hull surface 32 and forms an air gap 34 between magnet surface 26 and hull 32. The air gap, and therefore gasket thickness, in the range 0.060 inch to 0.150 inch has been found to be adequate to protect the device and maintain the minimum holding force.

Body member 12 is provided with a hole 36 extending through body member wall section 38. A line 40 passes through hole 36 and is secured behind body member wall section 38 by knotting. Other means of attaching line 40 to the body member are contemplated, and that shown herein is only illustrative of one means. Line 40 secures platform 22, as shown in FIG. 2, to the holder. Attachment of line 40 to the holder must be at the magnetic center of gravity CG, see FIG. 4, so that all of the forces exerted through the line are concentrated at the magnetic center of gravity, and therefore the magnetic holding force $F_1$ is utilized to its greatest extent in opposing these forces.

Figure 5:
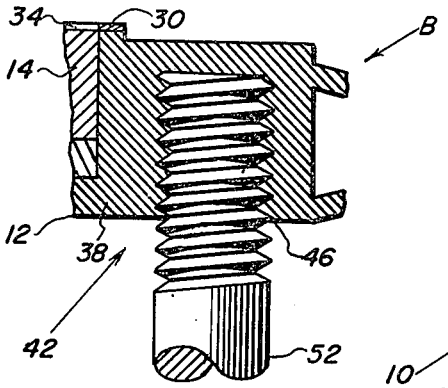
FIG. 5 is a vertical transverse section of B in FIG. 4 showing an alternative embodiment.
Figure 3:
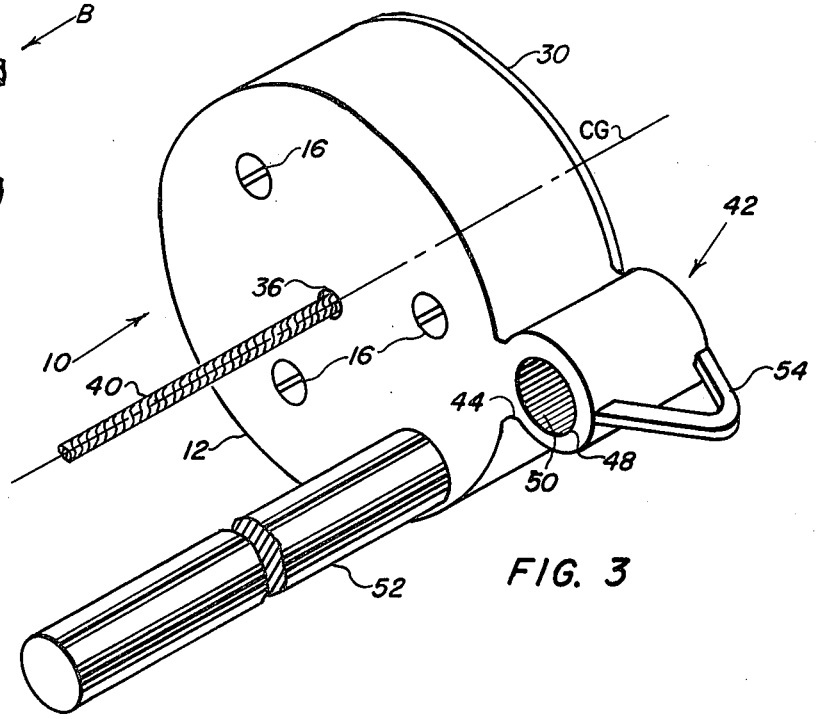
FIG. 3 is a perspective view of the preferred embodiment of the invention.

The holding ability of permanent magnet 14 is sharply reduced if subjected to jerks or sudden impulses opposite to its holding force $F_1$. The holder disclosed herein can be subjected to such jerks and impulses due to movement of platform 22 as personnel 20 go about their servicing operations. To help eleviate these effects, line 40 must be of a material that if flexible and resilient. In this way the impulse forces are dissipated in the line through stretching thereof, and not transmitted to the holder. Suitable line materials are cotton or nylon rope. Those skilled in rope and cable design and fabrication will be able to find other suitable resilient materials. Body member 12 includes an extension, shown generally as 42 in FIG. 4, disposed laterally from the magnet containing cavity portion 18 of the body member. Extension 42 is located at a point 44 on the periphery of cavity portin 18 as best shown in FIG. 3. Extension 42 includes a circular cavity 46, see FIG. 4, having and a resilient tubular insert 48 retained therein. Cavity 46 and insert 48 form a receptacle 50 for receiving an elongated tool 52, such as a broom stick like pole, and more commonly known to sailors as a man helper. Tool 52 is frictionally retained within receptacle 50 when inserted therein, but can be removed when the holder is secured to the hull. Alternatively, cavity 46 and tool 52 may be threaded, as shown in FIG. 5, to more securely retain the tool therein, and to transmit external removal force $F_3$, as more fully described hereinafter.

Extension 42 of the preferred embodiment, shown in FIG. 4, includes a rigid member 54 disposed laterally from the tool receiving cavity portion and may be in any shape capable of receiving an external force $F_2$. As best shown in FIG. 3, the locational relationship of magnet retaining cavity portion 18, tool receiving cavity portion 46 and rigid member 54 of body member 12 is such that the axis of each portion falls on and forms the longitudinal axis of body member 12, therefore all portions are in longitudinal alignment.

Body member 12, including the extension, defines a lever arm $l_2$ extending from the point of application 56 of external force $F_2$ to the point 58 on body member surface 28 farthest from extension 42.

The construction of body member 12 may be by welding, bolting, or otherwise securing individual pieces together or a one piece cast construction as shown herein. Whatever method of making is used, the materials should be ones that are corrosion resistant and light in weight. Suitable materials are plastic and aluminum alloys such as 5456 and 6061.

Referring again to FIG. 4, it is seen that a turning moment is created about point 58 by magnetic force $F_1$ and lever arm $l_1$ This moment tends to rotate holder 10 about point 58 and keep the holder secured to the hull. In opposition to moment $F_1l_1$ is a second turning moment $F_2l_2$ about point 58 created by external force $F_2$ and lever arm $l_2$. Moment $F_2l_2$ tends to rotate holder 10 away from the hull. Because lever arm $l_2$ is considerably longer than lever arm $l_1$, force $F_2$, required to rotate holder 10, is considerably less than magnetic force $F_1$. Release of the holder is therefore accomplished by applying a relatively small external force of extension 42. In the embodiment shown in FIG. 4, the external force is applied to extension 42 through rigid member 54, however it may also be applied through elongated tool 52 creating a third turning moment, $F_3l_3$. By applying the external force through tool 52 lever arm $l_3$ is created. Lever arm $l_3$ is defined by the thickness of body member 12 and the length of tool 52 protruding from cavity 46 to the point of application 60 of external force $F_3$. Because tool 52 can be of various and considerable length, lever arm $l_3$ can be made considerably larger than lever arm $l_2$, whereby turning moment $F_3l_3$ can be made even larger than moment $F_2l_2$ with resultant easy release of holder 10.

PREFERRED MODE OF OPERATION

In operation, personnel 20 are lowered from the deck of ship 33 on a platform 22 with conventional hoisting equipment 62. When at the desired locations on the hull, the elongated tool is inserted into the receptacle and line 40 is loosely secured to the platform. The holder is placed in contact with the hull by reaching outwardly with the tool. When the holder contacts the hull, the magnetic force secures it thereto. A second holder is secured to the hull in the same manner. The two lines are then brought in alternately until the platform is pulled to the desired position. Lines 40 are then tightly secured to the platform.

When it is desired to move to another location, the personnel pulls on either the rigid member or elongated tool as heretofore explained. When both holders are released the platform can be moved to another location.

Having described the details of the invention and its operation other embodiments and modifications will readily come to the mind of one skilled in the art having the benefit of the teachings presented in the foregoing description and drawings. It is therefore to be understood that said modification and embodiments are to be included within the scope of the appended claims.

What is claimed as new and secured by Letters Patent of the United States is:

1. A magnetic holder for securing a platform lowered from the deck of a ship to the surface of the hull of the ship for allowing personnel to service the hull comprising:

a permanent magnetic for creating a magnetic holding force, a body member containing said magnet, the magnet adapted to secure said body member to the surface of the hull of the ship, said body member including an extension rigidly attached to its periphery at a location on said body members' longitudinal axis displaced from the magnets' magnetic center of gravity for receiving an external force for removing said body member from the hull surface, said body member including said extension define a lever arm, with which said external force, when applied to the extension, define a turning moment providing a substantial mechanical advantage for overcoming the magnetic holding force; thereby causing release of the body member from the hull's surface with reduced effort, a flexible resilient member attaching the platform to body member at the magnetic center of gravity of said magnet, said resilient member adapted to prevent the transmission of impulse forces exerted by the platform to the holder by dissipating the forces through controlled stretching of said resilient member.

2. The holder as defined in claim 1 wherein said flexible resilient member is cotton rope.

3. The holder is defined in claim 1 wherein said flexible resilient member is nylon rope.

4. The holder as defined in claim 1 wherein said extension includes means for temporarily attaching an elongated tool for bringing the holder in contact with the hull's surface and for applying the extenal force to said extension for creating the turning moment for release of the body member from the hull's surface, said attachment means adapted to allow the tool to be removed and reattached to the extension by personnel from a location on the platform after said body member has been secured to the hull's surface.

5. The holder as defined in claim 4 wherein said means for attaching said elongated tool includes a cavity within said extension, a tubular resilient insert contained within said cavity adapted to receive and temporarily retain said elongated tool inserted therein by personnel.

6. The holder as defined in claim 4 wherein said means for attaching said elongated tool includes a threaded cylindrical cavity within said extension adapted to threadedly attach and release said elongated tool threaded therein by personnel.

7. The holder as defined in claim 4 wherein said extension also includes a rigid, closed generally loop shaped member attached to the periphery of the means for attaching the elongated tool on the longitudinal axis of said body member adapted to receive said external force and create the turning moment for release of the body member from the hull's surface.

8. The holder as defined in claim 1 wherein said permanent magnet creates a magnet holding force of a minimum of 60 pounds.

9. The holder as defined in claim 1 wherein the body member is made of corrosion resistant material.

10. The holder a defined in claim 9 wherein the corrosion resistant material is plastic.

11. The holder as defined in claim 9 wherein the corrosion resistant material is aluminum alloy.

* * * * *